US005178211A

United States Patent [19]

Bauer et al.

[11] Patent Number: 5,178,211

[45] Date of Patent: Jan. 12, 1993

[54] HEAT EXCHANGER

[75] Inventors: Dieter Bauer; Klaus Herrmann; Karl-Heinz Staffa, all of Stuttgart, Fed. Rep. of Germany

[73] Assignee: Behr GmbH & Co., Stuttgart, Fed. Rep. of Germany

[21] Appl. No.: 462,481

[22] Filed: Jan. 10, 1990

[30] Foreign Application Priority Data

Jan. 12, 1989 [DE] Fed. Rep. of Germany ..... 3900744

[51] Int. Cl.[5] ..... F28F 9/16; F28D 1/04; B21D 53/08

[52] U.S. Cl. ..... 165/153; 165/173; 165/906; 29/890.043; 29/890.052

[58] Field of Search ..... 165/148, 153, 173, 175, 165/179, 906; 29/890.039, 890.043, 890.049, 890.052

[56] References Cited

U.S. PATENT DOCUMENTS

| | | | |
|---|---|---|---|
| 1,586,984 | 6/1926 | Foster | 29/890.043 |
| 2,028,455 | 1/1936 | Karmazin | 29/890.052 |
| 2,153,806 | 4/1939 | Karmazin | 29/890.039 |
| 2,573,161 | 10/1951 | Tadewald | 165/153 |
| 3,689,972 | 9/1972 | Mosier et al. | 29/157.3 R |
| 3,857,151 | 12/1974 | Young et al. | 29/157.3 B |
| 3,972,371 | 8/1976 | Plegat | 165/153 |
| 3,981,356 | 9/1976 | Granetzke | 165/179 |
| 4,159,034 | 6/1979 | Bellovary et al. | 165/153 |
| 4,381,033 | 4/1983 | Woodhull, Jr. et al. | 165/175 |
| 4,570,700 | 2/1986 | Ohara et al. | 165/906 |
| 4,615,385 | 10/1986 | Saperstein et al. | 165/175 |
| 4,693,307 | 9/1987 | Scarselletta | 165/153 |
| 4,825,941 | 5/1989 | Hoshino et al. | 165/110 |

FOREIGN PATENT DOCUMENTS

| | | | |
|---|---|---|---|
| 22235 | 1/1981 | European Pat. Off. | 165/173 |
| 491039 | 2/1930 | Fed. Rep. of Germany | 165/148 |
| 3720483 | 1/1988 | Fed. Rep. of Germany . | |
| 815895 | 7/1937 | France | 165/148 |
| 2605726 | 4/1988 | France . | |
| 245094 | 10/1987 | Japan | 165/173 |
| 790704 | 2/1958 | United Kingdom | 165/173 |
| 904498 | 8/1962 | United Kingdom | 165/148 |

*Primary Examiner*—John Rivell
*Assistant Examiner*—L. R. Leo
*Attorney, Agent, or Firm*—Foley & Lardner

[57] ABSTRACT

A heat exchanger, in particular a coolant condenser which has a plurality of flat pipes, extending in parallel, and corrugated ribs are arranged between the flat pipes. The ends of the flat pipes are connected to corresponding openings in the base of junction boxes consisting of solder-plated material and are soldered to the junction boxes, wherein the flat pipes likewise consist of a soler-plated material and the ends have a round cross section, and a section with radial press-fit is present at the ends of the flat pipes in the region of the base of the junction boxes. The flat pipes consist preferably of material solder-plated on both sides, and supporting webs are situated in the flat pipes and are connected to the flat pipes by means of the solder of the flat pipes.

24 Claims, 4 Drawing Sheets

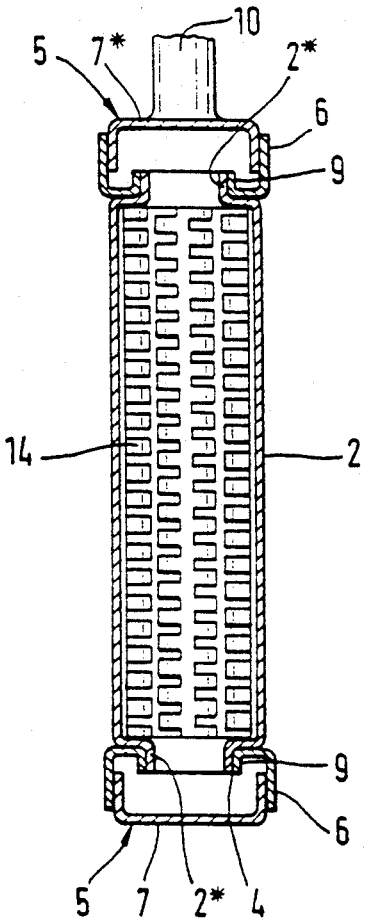
FIG. 4
FIG. 6
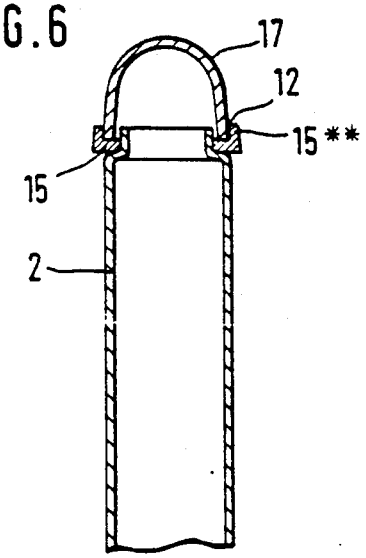
FIG. 5
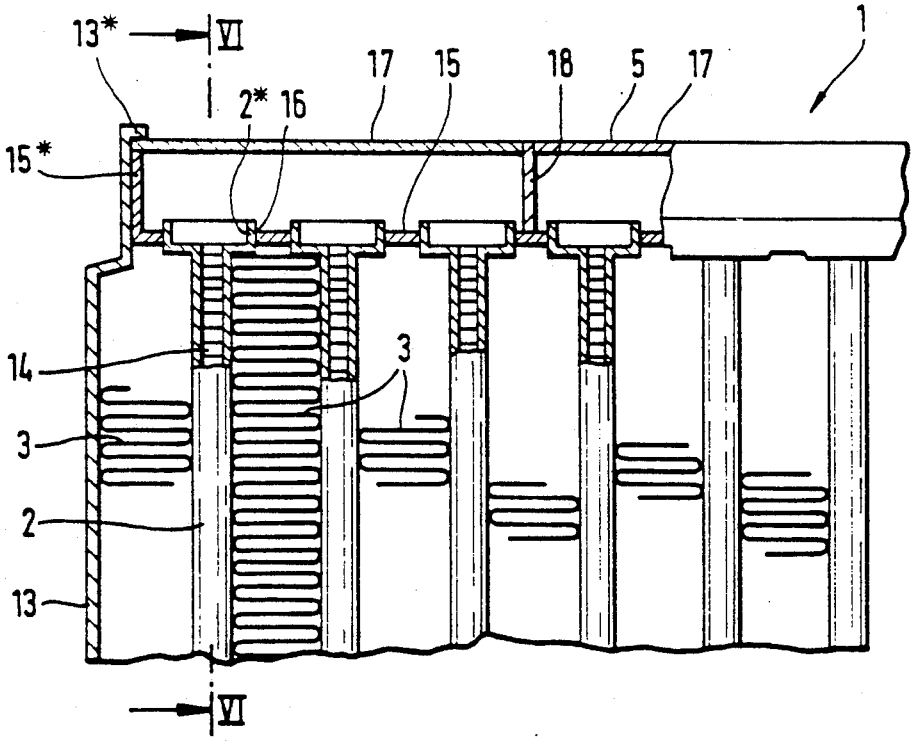

FIG. 7
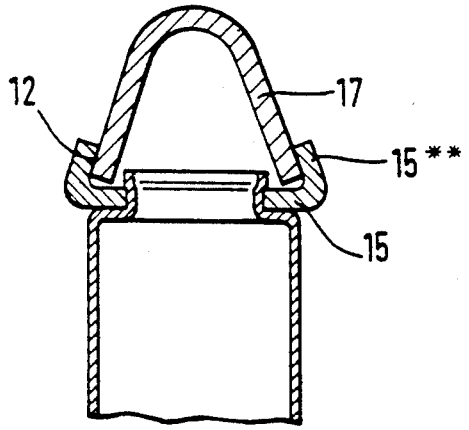
FIG. 8
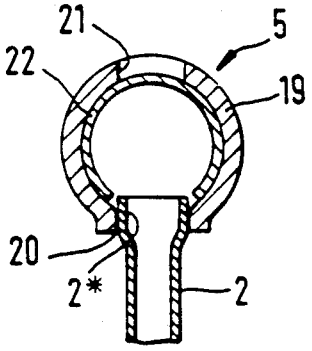
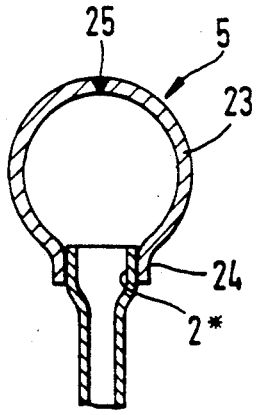
FIG. 9
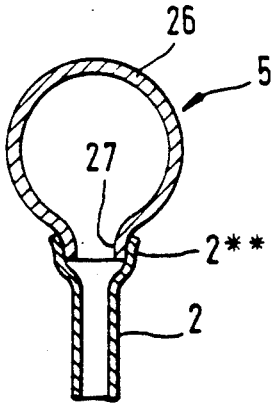
FIG. 10
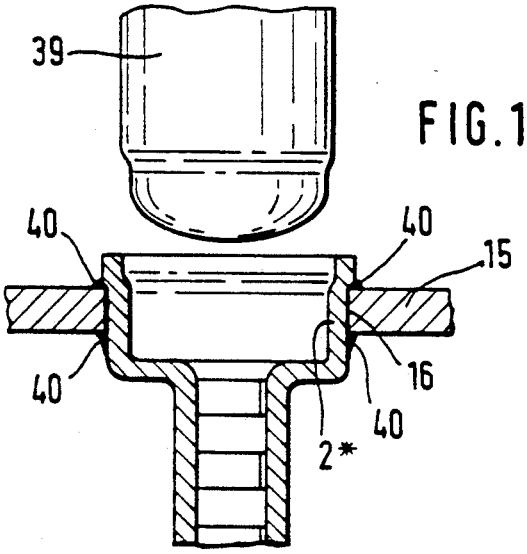
FIG. 18

FIG. 11
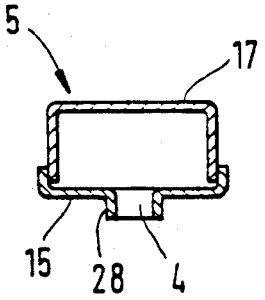
FIG. 12
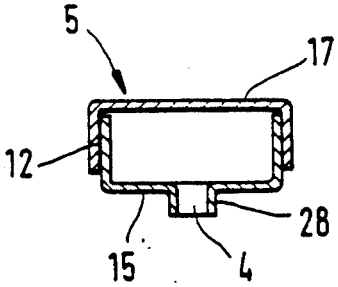
FIG. 13
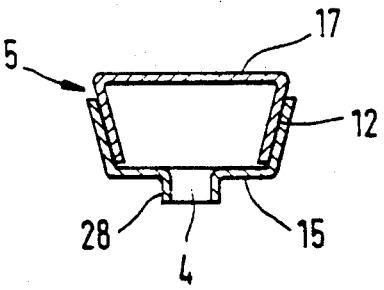
FIG. 14
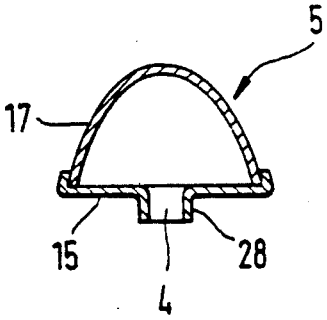
FIG. 15
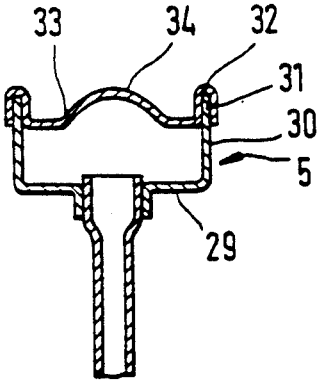
FIG. 17
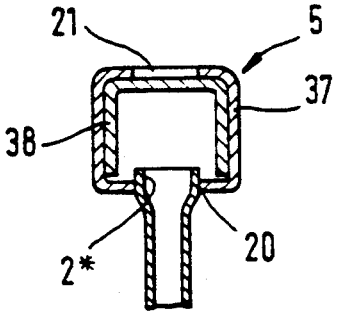
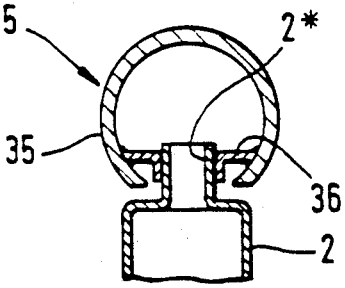
FIG. 16

HEAT EXCHANGER

BACKGROUND OF THE INVENTION

The invention relates to a heat exchanger, in particular a coolant condenser which has a plurality of flat pipes extending in parallel, and corrugated ribs are arranged between the flat pipes, wherein the ends of the flat pipes are connected to corresponding openings in the base of junction boxes of solder-plated material and being soldered to the junction boxes. A heat exchanger of this kind is known from EP-A-O,255,513. With this condenser the ends of extruded flat pipes are passed into elongated slots of a tubular junction box and soldered to the junction box. With production of this kind, the ends of the flat pipes must correspond exactly to the size of the slots so that tightness of the soldering point is achieved. The corrugated ribs are provided with a layer of solder in order to be soldered to the flat pipes which do not have any solder. With the known arrangement it is necessary for different junction boxes to be produced for different pipe cross sections, general use of one uniform type of junction boxes for different pipe cross sections is therefore not possible.

U.S. Pat. No. 3,689,972 describes a process, by means of which, with a flat pipe heat exchanger, after soldering the pipes into the junction boxes, the junction boxes are deformed to a desired cross sectional shape. Since the soldering of flat pipes into corresponding slots of junction boxes, in particular in the region of the parallel flat sides, is problematic, EP-A-O,198,581 proposed providing the base of the junction boxes with curves, by means of which the soldering of the flat pipes to the junction boxes should be improved.

Moreover, it is known from U.S. Pat. No. 3,857,151 with a flat pipe heat exchanger to shape the pipe ends to a round cross section in order to fasten the pipe in a pipe plate without soldering. However, for this kind of pipe/base connection it is necessary for a correspondingly long connection surface to be present between pipe and base in order to ensure the required strength and tightness. However, it has been established that non-soldered connections are not coolant-tight such that non-soldered heat exchangers can only be applied to a restricted extent and are unsuitable for coolant circuits.

A heat exchanger suitable for coolant circuits is described in DE-A-3,622,953. This heat exchanger consists of flat pipes, the pipe ends of which are extended in relation to the central sections, the parallel sides of the ends of in each case adjacent pipes lying next to one another. This heat exchanger does not have junction boxes because the pipe ends lying next to one another of the parallel flat pipes are connected to one another and, in this manner, take over the function of the junction boxes.

SUMMARY OF THE INVENTION

It is therefore an object of the present invention to provide a heat exchanger in particular a coolant condenser in which a mechanically strong and fluid-tight, in particular coolant-tight connection of pipe and junction boxes is achieved with extremely small soldering gaps and in which the corrugated ribs are soldered to the flat pipes without additional application of solder.

Another object of the present invention is to provide a heat exchanger in which junction boxes with uniform connection tubes or openings can be used for different flat pipes and to provide a heat exchanger with improved production reliability.

In accomplishing these and other objects, there has been provided according to the present invention a heat exchanger, in particular a coolant condenser comprising first and second junction boxes, each junction box having a base which faces the base of the other junction box and which contains openings therein; a plurality of generally flat pipes, extending in parallel between the junction boxes; and corrugated ribs arranged between the flat pipes, wherein the ends of the flat pipes are connected to the openings in the bases of the junction boxes and are soldered to the junction boxes, wherein the junction boxes and the flat pipes are formed of a solder-plated material, wherein the ends of the flat pipes have a generally round or oval cross section, and wherein a section with a radial press-fit is present at the ends of the flat pipes in the region of the base of the junction boxes.

Further objects, features and advantages of the present invention will become apparent from the detailed description of preferred embodiments which follows, when considered together with the attached drawings.

BRIEF DESCRIPTION OF THE DRAWINGS

FIG. 4 shows a section through a heat exchanger pipe with the junction boxes along the line IV—IV in FIG. 1, FIG. 5 shows an extract of an alternative embodiment to the representation in FIG. 1, FIG. 6 shows a section along the line VI—VI in FIG. 5, FIG. 7 shows an alternative embodiment to FIG. 6 in enlarged representation, FIG. 8 shows a section through a junction box comprising two concentric pipes, FIG. 9 shows a section through a longitudinally welded junction box, FIG. 10 shows another embodiment of a longitudinally welded junction box similar to FIG. 9, FIGS. 11–14 show other embodiments of the junction box similar to FIG. 6, FIG. 15 shows a section through another embodiment of the junction box in which the lid part has a groove-shaped indention, FIG. 16 shows another embodiment of a junction box in which the cross section of the lid part is larger than a semicircle, FIG. 17 shows a further embodiment of a junction box comprising two concentric pipes similar to FIG. 8, FIG. 18 shows an enlarged representation of the base part and the pipe end in FIG. 5.

DETAILED DESCRIPTION OF THE PREFERRED EMBODIMENTS

Figure 1:
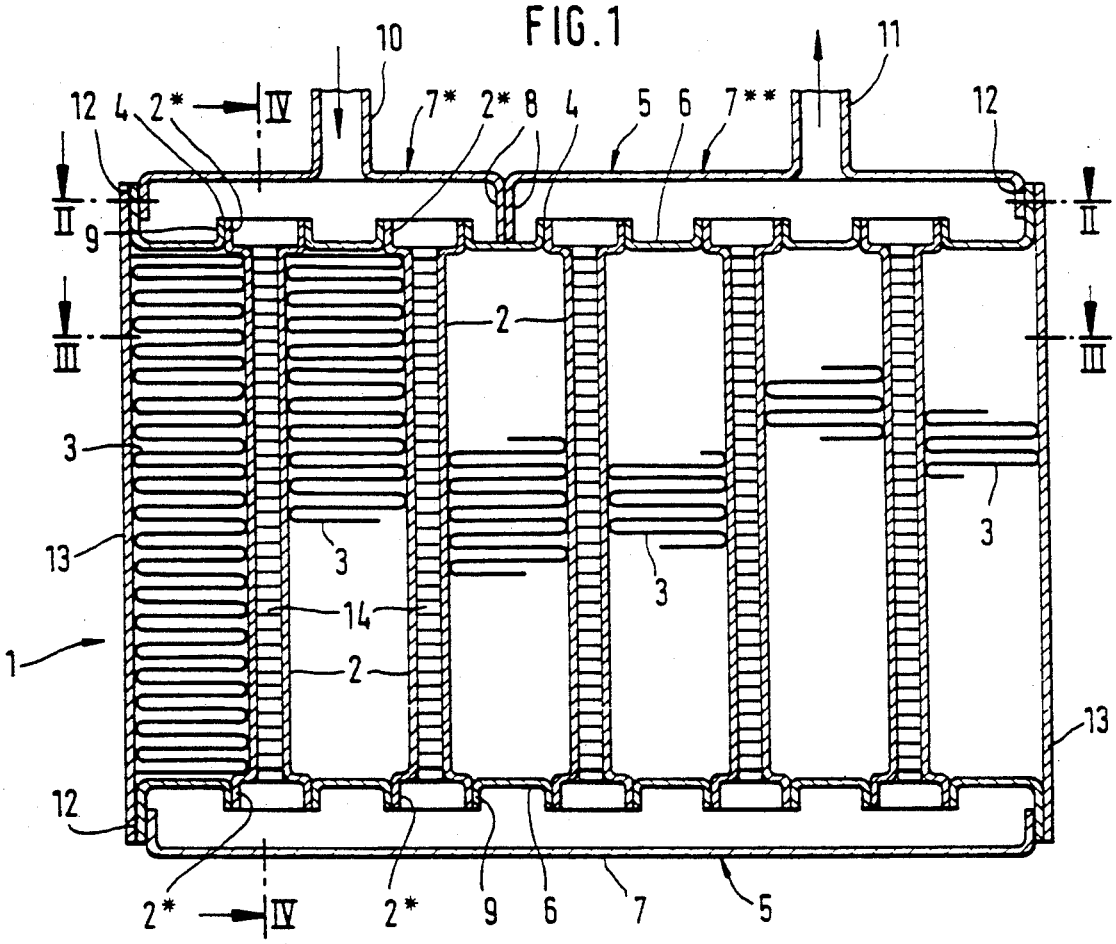
FIG. 1 shows a longitudinal section through a heat exchanger.

The invention comprises a heat exchanger having a plurality of flat pipes, extending in parallel, and corrugated ribs arranged between the flat pipes, the ends of the flat pipes are connected to corresponding openings in the base of junction boxes consisting of solder-plated material and being soldered to the junction boxes wherein the flat pipes likewise consist of a solder-plated material, the ends of the flat pipes have a round cross section, and a section with radial press-fit is present at these ends in the region of the base of the junction boxes. Thus a mechanically strong and fluid-tight, in particular coolant-tight connection of pipe and base is achieved by an extremely small soldering gap and in which the corrugated ribs are soldered to the flat pipes without additional application of solder. The essential advantages of the invention are that a large production reliability is achieved since tolerances in the section with radial press-fit are completely removed and, due to the cross sections of the pipe ends being independent of the size of the flat pipe, junction boxes can be used with uniform connection tubes or openings.

According to a preferred embodiment of the invention, the flat pipes consist of material solder-plated on both sides and situated in the flat pipes are supporting webs which are connected to the flat pipes in a material-fitting manner by means of the solder. The advantage of this measure consists in the fact that the flat pipes are extremely stable in shape and also withstand extreme pressure stresses both from inside and from outside as well, since the webs not only act as supports, but also as tie rods between the parallel flat sides of the pipes.

The flat pipes are expediently constructed as welded aluminum pipes since these meet the requirements particularly well on the one hand in respect of their high strength and, on the other hand, in respect of the shapeability of the pipe ends.

In order that no lost construction space arises between the heat exchanger network and the junction boxes, it is advantageous that the round ends are molded onto the flat pipes without a transition area. However, in particular for reasons of flow or production processes, a short transition area can also be provided between the flat pipe and the round pipe ends. In this case, both a pipe with a flat cross section, the ends of which are shaped to form a circular or oval cross section, can be the starting point, just as well as pipes with an originally round cross section can however be considered which are pressed together in the region between the ends to a flat pipe cross section with parallel side walls. However, it is important with circular pipe ends that the supporting webs to be soldered are introduced into the pipe prior to the deformation process of the pipe or the pipe ends; with oval, expanded pipe ends the supporting webs can also be pushed in afterwards.

To increase the strength in the region of the pipe/-base connection, it is suggested that the openings of the junction boxes are enclosed by connection tubes which are directed into the junction boxes or towards the corrugated ribs. In this manner, a larger contact surface results between pipe and base, which leads in particular to the increase of mechanical strength.

An expedient embodiment of the subject of the invention consists in the fact that the ends of the flat pipes are situated in openings of the junction boxes and the section with radial press-fit is generated by radial expansion of the ends in the region of the base. This expansion can be performed with the aid of an arbor. If the ends of the flat pipes are plugged via connection tubes on the base of the junction box, it is expedient that the radial press-fit between the pipe end and the base is generated by radial pressing together of the pipe ends.

In order to reduce the number or the length of the soldered connections on the junction box, the junction box can be constructed as an integral pipe. With a design of this kind, the pipe forming the junction box can firstly be open at its side diametrically opposite the pipe ends of the flat pipes such that a tool can be introduced to expand the pipe ends in the base. As soon as the press-fit is generated between the pipe ends and the base, the pipe forming the junction box is deformed in such a way that a closed pipe shape arises, the seam point of which is closed by welding.

A further embodiment of the invention consists in the fact that the junction boxes consist of two pipes inserted concentrically one inside the other, the outer pipe having openings diametrically opposite the openings to receive the pipe ends of the flat pipes, which openings are covered by the inner pipe. These opposite openings serve the purpose of enabling a tool to be introduced to generate the radial press-fit. When soldering the heat exchanger, the inner pipe is soldered to the outer pipe such that the openings opposite the pipe plate are sealed in a fluid-tight or coolant-tight manner.

A further embodiment of the junction boxes consists in the fact that these each comprise a base part and a lid part which are soldered to one another at the connection surfaces. By this embodiment, an expansion tool can firstly be advantageously introduced into the pipe ends to generate the compression and, subsequently, the lid part is placed onto the base part. The lid part and base part are soldered at the same time as the soldering of the corrugated ribs to the flat pipes and the pipe ends in the base of the junction box. The lid parts and base parts preferably have overlapping and/or interlocking regions, by means of which a large soldering surface and thus a high mechanical strength results.

To stipulate the throughflow direction through the pipe system of the heat exchanger, for example in a zig-zag manner, and to divide the flow in respect of different flow cross sections, it is expedient to arrange in the junction boxes means to divert the flow. These means to divert the flow can be formed, for example, by angled sections of the lid parts. By this construction, the number of soldered connections can be reduced to a minimum. If profiled material is to be used for the lid parts, the means to divert the flow are formed by partitions inserted between lid part sections.

For the heat exchanger according to the invention, not only drawn, welded or soldered pipes are considered, but the flat pipes can also consist of an extruded profile which, over the entire, non-deformed length, has at least one supporting web between the parallel side walls. Extruded profiles of this kind offer a particularly high strength; however the effort required to produce a round pipe end from an extruded flat pipe is greater than with the other types of pipe.

FIG. 1 shows the section through a heat exchanger 1 which comprises several flat pipes 2, extending in parallel, and corrugated ribs 3 arranged in between the said flat pipes. The flat pipes 2 have ends 2* with a round cross section, which are molded directly onto the flat pipes 2 without a transition area and are fastened in corresponding openings 4 of junction boxes 5. The junction boxes 5 are formed from a base part 6 and a lid part 7. In FIG. 1, the upper junction box 5 comprises two lid parts 7*, 7, which together cover the entire base part 6. In this arrangement, sections 8, angled inwards, of the lid parts 7* and 7**** form flow conduction means, by means of which the division of the entire flow of fluid is determined over a certain number of pipes switched in parallel.

Situated in the flat pipes 2 are supporting webs 14 which are soldered to the inside wall of the flat pipes 2 and, in this manner, give the flat pipes a great stability both with tensile stress from inside and with compression stress from outside. The upper lid part 7* shown on the left of FIG. 1 has a fluid inlet 10 and the lid part 7 shown on the right has a fluid return 11. The lid parts 7, 7* and 7** are soldered in each case to the base parts 6 along the circumferential edge. In order to generate a large soldering surface overlapping regions 12** are provided.

The base parts 6 have connection tubes 9 directed into the junction box, which connection tubes enclose the openings 4. The pipe ends 2* are fastened in the base parts 6 by radial expansion and, additionally, soldering in a fluid-tight or coolant-tight manner. Side parts 13 are soldered on for the lateral limitation of the end face of the heat exchanger 1 and for supporting the outer corrugated ribs 3.

Figure 2:
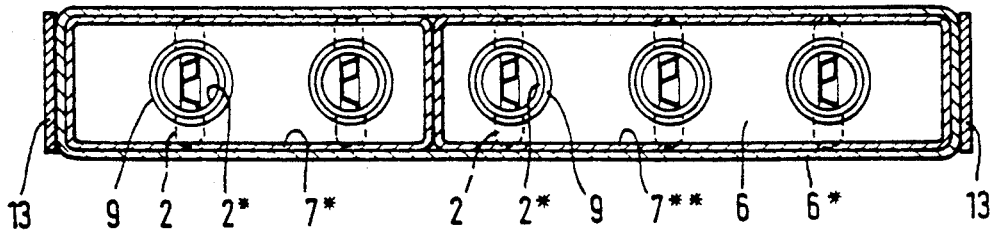
FIG. 2 shows a section through a junction box along the line II—II in FIG. 1.

FIG. 2 shows a section along the line II—II in FIG. 1. It can be seen from this drawing that the connection tubes 9 and also the ends 2* of the flat pipes 2 have a circular cross section. The lid parts 7* and 7 are situated inside a circumferential edge 6* of the base part 6, to the narrow sides of which the side parts 13** are fastened.

Figure 3:
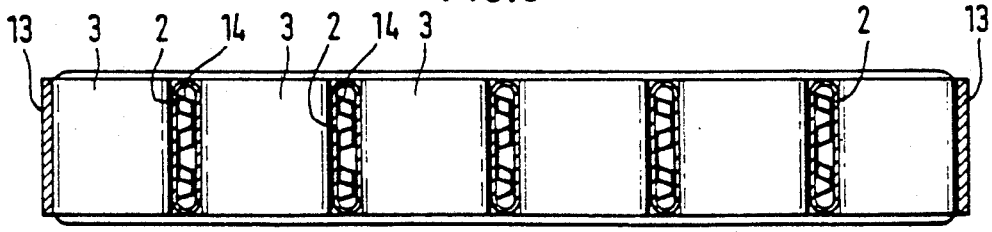
FIG. 3 shows a section through a heat exchanger block along the line III—III in FIG. 1.

FIG. 3 shows a section along the line III—III in FIG. 1. From this drawing, the elongated cross section of the flat pipes 2 can be seen with the supporting webs 14 situated therein. The corrugated ribs 3 are arranged between two adjacent flat pipes 2 or between the flat pipes 2, lying on the outside, and the side parts 13. The corrugated ribs 3 are soldered to the planar surfaces of the flat pipes 2 and the side parts 13.

FIG. 4 shows the section along the line IV—IV in FIG. 1. This view shows the flat pipe 2 in its longitudinal axis of the cross section with the molded-on, round ends 2*. In the flat pipe 2 there is a metal insert which forms the supporting webs 14. The ends 2* of the flat pipes 2 are situated in the connection tubes 9 of the base parts 6 which together with the lid part 7 or 7* form the lower or upper junction box 5. Situated at the upper junction box 5 is the fluid inlet 10.

FIG. 5 represents an extract of a longitudinal section through a heat exchanger 1 which, compared to the embodiment in FIG. 1, has a different construction of the junction box 5. The heat exchanger block is formed from flat pipes 2, extending in parallel, and corrugated ribs 3 situated in between the said flat pipes, the ends 2* of the flat pipes 2 being situated in openings 16 of a base part 15. With this embodiment, the base part 15 is of planar shape and has angled side walls 15* only on the two narrow sides.

The ends 2* of the flat pipes 2 are held in the base part 15 firstly by radial press-fit as a result of radial expansion and later, during soldering of the heat exchanger 1, these connection points are additionally soldered. This is referred to in greater detail later in the description of FIG. 18.

The base part 15, together with an arc-shaped profile piece 17, forms the junction box 5 which has an inserted partition 18 as a means to divert the flow. In this manner, it is very easy to divide up the pipe groups of the heat exchanger since the partitions 18 can be provided at optional points and, correspondingly, the partial lengths of the profile pieces 17 can be determined. Situated at the lateral edge of the heat exchanger 1 is the side part 13 which with an angled end 13* overlaps the upper rim of the lid part 17.

FIG. 6 shows a section along the line VI—VI in FIG. 5. It can be seen from this view that the lid part 17 comprises an arc-shaped profile piece which is placed on the base part 15. The base part 15 is provided along its longitudinal sides with an edge 15 directed upwards which results in an overlapping region 12 of the base part 15 and the lid part 17**.

In enlarged representation, FIG. 7 shows an embodiment similar to FIG. 6. In this embodiment, the lid part 17 is of V-shaped construction (in this case upside down) and the edges 15 directed upwards along the longitudinal side of the base part 15 are arranged at an angle to the longitudinal axis of the base part 15 which is adapted to correspond to the V-shape of the lid part 17. Resulting from this structure of base part 15 and lid part 17 is a form-fitting connection which, additionally, creates an overlapping region 12** with a corresponding soldering surface.

FIG. 8 shows a section through a junction box 5 with an end 2* of a flat pipe 2 fastened therein. The junction box 5 comprises two concentric pipes, an outer pipe 19 having openings 20 to receive the pipe ends 2* and further openings 21 diametrically opposite to the pipe ends 2*. The openings 21 are provided for the purpose of introducing a tool for generating a radial press-fit between the pipe end 2* and the outer pipe 19. After completion of this stage, an inner pipe 22 is arranged concentrically in the outer pipe 19 such that the openings 21 are covered. During soldering of the heat exchanger, the ends 2* of the flat pipes 2 and the inner pipe 22 are soldered to the outer pipe 19 which results in a fluid-tight connection.

FIG. 9 shows an embodiment of the junction box 5 with an integral pipe 23. During production of the heat exchanger, this pipe 23 is firstly open at its upper side, whereby the gap in the jacket surface of the pipe 23 is sufficient to introduce a tool for generating the radial press-fit between the pipe end 2* and a connection tube 24 of the junction box 5. After production of the radial press-fit, the jacket parts of the pipe 23 are deformed in such a way that they result in a closed shape and, finally, the seam point 25 is closed by welding.

FIG. 10 shows an embodiment in which the junction box 5 comprises an integral pipe 26 with connection tubes 27 directed outwards. One end 2 with a round cross section of a flat pipe 2 is plugged onto the connection tube 27, which end is pressed against the connection tube 27** by a force acting radially inwards.

FIGS. 11 to 14 show other embodiments of junction boxes 5 which, with regard to the two-part design, correspond essentially to FIG. 6. These embodiments refer to the cross sectional shape of the junction boxes which comprise a base part 15 and a lid part 17. The base parts have connection tubes 28 directed outwards which enclose the openings 4 to receive pipe ends. In this case, the embodiments according to FIGS. 12 and 13 have particularly large overlapping regions 12 between the base part 15 and the lid part 17. The shape of the junction boxes 5 in FIGS. 11 to 14 enables molded parts to be used which is favorable in respect of the production costs.

FIG. 15 shows a junction box 5 in which a base part 29 along the entire circumferential edge has wall parts 30 directed upwards, the upper edge 31 of which engages in a groove-shaped indentation 32 of a lid part 33. By means of this shape, a high mechanical strength and large soldering surface is achieved. The lid part 33 has a curvature 34 for compression stability.

FIG. 16 shows a junction box 5 with an end 2*, fastened therein, of a flat pipe 2, in which a lid part, seen in cross section, has the shape of a circular section which is larger than a semicircle. Situated in this lid part 35 is a base part 36, constructed as a planar sheet with a connection tube directed outwards, which base part is soldered to the lid part 35 at its lateral edges. During assembly of this unit, the base part 36, which has already been provided with the flat pipes 2, is introduced into the lid part 35 in the area in which the lid part 35 has its greatest inside width, and then the lid part 35 is moved upwards as seen in FIG. 16 such that the lateral edges of the base part 36 come to rest on the inside wall of the lid part 35.

FIG. 17 shows an embodiment of the junction box 5 similar to FIG. 8. The difference resides in the fact that the junction box 5 comprises rectangular pipes, namely one outer pipe 37 and one inner pipe 38. The outer pipe 37 has openings 20 to receive the pipe ends 2* and at the diametrically opposite side openings 21 for passing a tool through.

In enlarged representation FIG. 18 shows the connection arrangement of the base part 15 and the pipe end 2* in FIG. 5. Prior to introducing the pipe end 2* into the opening 16 in the base part 15, the pipe end 2* has an outside dimension which is somewhat smaller than the opening 16. By this means, the pipe end 2* can easily be introduced into the opening 16. With the aid of a tool 39, for example in the form of an arbor, the pipe end 2* is expanded radially such that it comes to a secure rest in the opening 16 against the base part 15. The tool 39 is preferably shaped in such a way that the region, situated inside the junction box, of the pipe end 2* receives a larger dimension in relation to the opening 16 in the base part 15. During soldering of the heat exchanger, a material-fitting connection is effected along the entire contact surface of the pipe end 2* and the base part 15 and, in each case, solder beads 40 are formed to the sides of the base part 15.

With all the exemplary embodiments represented, the parts forming the junction boxes 5 as well as the flat pipes consist of solder-plated material, whereby the flat pipes 2 being solder-plated on both sides due to the supporting webs 14 situated therein. With the components forming the junction boxes 5 it is also recommended to use solder-plated material on both sides with some embodiments, in particular with the embodiments according to FIGS. 1 to 8, 12 and 15 to 18. Although the pipe ends 2* in FIG. 2 are represented with a circular cross section, an oval shaping of the connection tubes or openings and pipe ends is, of course, also possible.

What is claimed is:

1. A heat exchanger, in particular a coolant condenser comprising:

first and second junction boxes, each junction box having a base which faces the base of the other junction box and which contains openings formed therein;

a plurality of generally flat pipes, extending in parallel between said junction boxes; and corrugated ribs arranged between the flat pipes, wherein the ends of the flat pipes are connected to said openings in the bases of said junction boxes and are soldered to the junction boxes, wherein said junction boxes and said flat pipes are formed of a solder-plated material, wherein the ends of the flat pipes have a generally round or oval cross section, and wherein end sections of the flat pipes are radially press-fit to the base of the junction boxes.

2. A heat exchanger as claimed in claim 1, wherein the flat pipes are formed of material solder-plated on both sides, and the heat exchanger further comprises supporting webs which are situated in the flat pipes and connected to the flat pipes by means of the solder of said flat pipes.

3. A heat exchanger as claimed in claim 1, wherein the flat pipes comprise welded aluminum pipes.

4. A heat exchanger as claimed in claim 1, wherein the round ends are molded onto the flat pipes without a transition area.

5. A heat exchanger as claimed in claim 1, wherein a short transition area is present between the flat pipe and the round end.

6. A heat exchanger as claimed in claim 1, wherein said openings in the bases of the junction boxes are surrounded by connection tubes.

7. A heat exchanger as claimed in claim 1, wherein the ends of the flat pipes are situated in openings of the junction boxes and the section with radial press-fit in the region of the base is generated by radial expansion of the ends.

8. A heat exchanger as claimed in claim 6, wherein the connection tubes extend into the ends of the flat pipes and the radial press-fit between pipe end and base is generated by radial pressing together of the pipe ends.

9. A heat exchanger as claimed in claim 1, wherein the junction boxes are formed of aluminum solder-plated on both sides.

10. A heat exchanger as claimed in claim 1, wherein the junction boxes are formed as an integral pipe.

11. A heat exchanger as claimed in claim 10, wherein the pipe has a welded seam on its side diametrically opposite the pipe ends.

12. A heat exchanger as claimed in claim 7, wherein the junction boxes are formed of two pipes inserted concentrically one inside the other, the outer pipe comprising access openings diametrically opposite the openings to receive the pipe ends, which openings are covered by the inner pipe.

13. A heat exchanger as claimed in claim 1, wherein the junction boxes each comprise a base part and a lid part which are soldered to one another at their connection surfaces.

14. A heat exchanger as claimed in claim 13, wherein lid parts and base parts have overlapping regions.

15. A heat exchanger as claimed in claim 13, wherein means for diverting flow of a cooling fluid are arranged in the junction boxes.

16. A heat exchanger as claimed in claim 15, wherein the means for diverting the flow are formed by angled sections of the lid parts.

17. A heat exchanger as claimed in claim 15, wherein the means for diverting the flow are formed by partitions inserted between lid part sections.

18. A heat exchanger as claimed in claim 1, wherein the flat pipes are shaped at their ends to form an oval cross section.

19. A heat exchanger as claimed in claim 1, wherein the flat pipes comprise a pipe with an initially circular or oval section, which has been pressed together in the region between the ends to a flat pipe cross section with parallel side walls.

20. A heat exchanger as claimed in claim 1, wherein the flat pipes comprise an extruded profile having at least one supporting web between the parallel side walls.

21. A heat exchanger as claimed in claim 1, wherein the openings of the junction boxes are surrounded by connection tubes which are directed inwardly of the junction boxes.

22. A heat exchanger comprising:

first and second junction boxes formed of a solder-plated material, each junction box having a base which faces the base of the other junction box and which contains openings formed therein;

a plurality of generally flat pipes formed of a material which is solder plated on both sides, said flat pipes extending in parallel between said junction boxes;

corrugated ribs arranged between the flat pipes; and supporting webs which are disposed within the flat pipes and connected to the flat pipes by means of the solder of said flat pipes and which are adapted to give said flat pipes stability under the imposition of stresses from both the inside and the outside of said pipes, wherein the ends of the flat pipes are connected to said openings in the bases of said junction boxes and are soldered to the junction boxes, wherein the ends of the flat pipes have a round cross section, and wherein end sections of the flat pipes are radially press-fit to the base of the junction boxes.

23. A method of assembling a heat exchanger, said method comprising the steps of:

(A) providing first and second junction boxes having outer surfaces formed of a solder-plated material, each junction box having a base which faces a base of the other junction box and which has openings formed therein;

(B) providing a plurality of flat pipes having outer surfaces formed of a solder plated material;

(C) inserting opposed rounded ends of each of said pipes into said openings formed in said first and second junction boxes so that said pipes extend in parallel between said junction boxes;

(D) press-fitting each of said ends of each of said pipes onto the base of the respective junction box;

(E) providing corrugated ribs between said flat pipes; and (F) soldering said pipes to said junction boxes and soldering said corrugated ribs to said pipes.

24. The method of claim 23, further comprising the step of soldering a plurality of supporting webs within each of said flat pipes in order to give said flat pipes stability under the imposition of stresses from both the inside and the outside of said pipes.

* * * * *